United States Patent [19]

Neidiffer et al.

[11] Patent Number: 5,055,625

[45] Date of Patent: Oct. 8, 1991

[54] GASOLINE ADDITIVE COMPOSITION AND METHOD FOR USING SAME

[75] Inventors: Fred Neidiffer, P.O. Box 2497, Capistrano Beach, Calif. 92624; Charles E. Fox, Durant, Iowa

[73] Assignee: Fred Neidiffer, Capistrano Beach, Calif.

[21] Appl. No.: 475,829

[22] Filed: Feb. 6, 1990

[51] Int. Cl.[5] ..... C10L 1/16

[52] U.S. Cl. ..... 585/14; 585/24; 208/17

[58] Field of Search ..... 585/14, 24; 208/17

[56] References Cited

U.S. PATENT DOCUMENTS

| | | | |
|---|---|---|---|
| 1,495,501 | 5/1924 | Taber | 208/17 |
| 1,954,939 | 4/1934 | Magness | 208/16 |
| 2,593,561 | 4/1952 | Herbst et al. | 208/17 |
| 3,807,974 | 4/1974 | Kerley et al. | 44/76 |
| 4,011,166 | 3/1977 | Schenach | 585/24 |
| 4,116,644 | 9/1978 | Jackisch et al. | 44/73 |
| 4,244,807 | 1/1981 | Dautzenberg | 208/79 |

FOREIGN PATENT DOCUMENTS

| | | | |
|---|---|---|---|
| 0686443 | 2/1982 | U.S.S.R. | 208/17 |

OTHER PUBLICATIONS

*American Petroleum Refining*, Bell pp. 295–301.
*Petroleum Processing*, R. J. Hengstebeck, p. 4.
*The Petroleum Handbook*, P. M. Nash, p. 383.

*Primary Examiner*—Margaret B. Medley
*Attorney, Agent, or Firm*—Gordon L. Peterson; Frank J. Uxa, Jr.

[57] ABSTRACT

A composition useful as a gasoline additive, preferably to increase engine performance and/or mileage per unit volume of fuel, is described. The composition comprises about 45% to about 55% by weight of toluene and about 45% to about 55% by weight of $C_8$ alkyl aromatic component selected from the group consisting of ethylbenzene, paraxylene, metaxylene, orthoxylene and mixtures thereof.

25 Claims, No Drawings

GASOLINE ADDITIVE COMPOSITION AND METHOD FOR USING SAME

BACKGROUND OF THE INVENTION

This invention relates to a composition and method useful for enhancing the performance of a gasoline-fueled, spark ignited internal combustion engine. More particularly, the invention relates to a composition and method useful for enhancing the performance of such an engine used to power a transportation vehicle and preferably to increase the mileage per unit of fuel obtained by the transportation vehicle.

Gasoline compositions are useful for fueling certain spark ignited internal combustion engines, particularly such engines associated with transportation vehicles. Various additives have been suggested to increase the effectiveness and efficiency of such fuels. For example, certain oxygenates, such as alcohols and ethers, have been suggested as additives for gasoline compositions. However, such materials are already partially combusted (oxidized) and so the amount of power per unit of oxygenate is often reduced relative to that of hydrocarbon fuels. Other additives which have been suggested include one or more petroleum fractions which have a relatively high octane number and a relatively broad boiling range. Thus, although the fraction as a whole has a high octane number, it is often composed of numerous individual compounds some of which have lower octane numbers than the base gasoline fuel to which it is added, and/or have other detrimental effects on the performance and/or mileage per unit of fuel of the engine in which the additive is used.

SUMMARY OF THE INVENTION

A new composition and method useful for enhancing the performance of a gasoline-fueled, spark ignited internal combustion engine has been discovered. The present composition, which is made from readily available materials and has a specific defined make-up, provides for outstanding increases in the performance of such gasoline-fueled spark ignited internal combustion engines. Preferably, the inclusion of the present compositions into the fuel supply of such an engine associated with a transportation vehicle results in an increase in the mileage per unit volume of fuel of such vehicle. No special engine adjustments or settings are required in order to achieve the beneficial results of the compositions and methods of the present invention. Moreover, a conventional, gasoline-fueled, spark ignited engine is able to use a gasoline composition containing the present addition composition with substantially no risk of damage or other harm to the engine resulting from such use. In short, the present invention provides a safe and very effective means for enhancing the performance of a gasoline-fueled spark ignited internal combustion engine.

The present composition comprises about 45% to about 55% by weight of toluene and about 45% to about 55% by weight of $C_8$ alkyl aromatic component selected from the group consisting of ethylbenzene, paraxylene, metaxylene, orthoxylene and mixtures thereof. These compositions are preferably used in a method which comprises adding such a composition to the fuel tank of a gasoline-fueled, spark ignited internal combustion engine associated with a transportation vehicle.

DETAILED DESCRIPTION OF THE INVENTION

The present compositions include both toluene and a $C_8$ alkyl aromatic component each in a defined concentration range. Both toluene and the $C_8$ alkyl aromatic compounds are known to have relatively high octane numbers and to be present in conventional gasolines. However, it is quite unexpected that a composition comprising about 45% to about 55% by weight of toluene and about 45% to about 55% by weight of $C_8$ alkyl aromatic component provides the outstanding enhancement in engine performance, and preferably mileage per unit volume of fuel, achieved in the present invention. It is important to note that mixtures of toluene and $C_8$ alkyl aromatic component which do not meet the compositional parameters of the present invention fail to provide the improvement in engine performance achieved by the present compositions. In one particularly useful embodiment, the toluene and $C_8$ alkyl aromatic component are the only essential materials in the present compositions.

Toluene is present in the compositions of this invention in an amount in the range of about 45% to about 55%, more preferably about 50% to about 55% by weight. Excellent results are obtained with compositions which include about 53.4% weight of toluene.

The $C_8$ alkyl aromatic component is present in the compositions of this invention in an amount in the range of about 45% to about 55%, preferably about 45% to about 50%, by weight. Excellent results are achieved with compositions which include about 46.6% by weight of $C_8$ alkyl aromatic component. The $C_8$ alkyl aromatic component may include any one or a mixture of any two or more of ethylbenzene, paraxylene, metaxylene and orthoxylene. Preferably, the $C_8$ alkyl aromatic component is a mixture of ethylbenzene, paraxylene, metaxylene and orthoxylene. The major amount, i.e., at least about 50% by weight, of the $C_8$ alkyl aromatic component is preferably metaxylene.

The present compositions may include minor amounts of one or more other components, such as conventional materials included to perform one or more designated functions. For example, the present compositions may include one or more components conventionally found in gasoline. However, it is preferred that the present compositions be substantially free, i.e., include less than about 5% by weight, more preferably less than 1% by weight, of $C_9$ alkyl aromatic components and higher boiling hydrocarbonaceous components.

The present compositions may be used in combination with any suitable gasoline composition. Such gasoline compositions (i.e., before the inclusion of the present additive compositions) comprise a mixture of hydrocarbons boiling in the gasoline boiling range. Typically, the gasoline compositions comprise hydrocarbons which boil primarily in the range from about 50° F. to about 500° F. The gasoline compositions may include straight chain or branched chain paraffins, cyclo-paraffins, olefins and aromatic hydrocarbons or any mixture of these. These gasoline compositions can be derived from straight run naphtha, polymer gasoline, natural gasoline or from catalytically cracked or thermal cracked hydrocarbons and catalytically reformed stocks. The make-up of the gasoline composition is not critical to the present invention. Any conventional gasoline composition may be employed in the practice of this invention.

The gasoline composition may contain any of the additives normally employed in a motor fuel. For example, the gasoline composition may contain an anti-knock compound, such as a tetraalkyllead compound including tetraethyllead, tetramethyllead, tetrabutyllead, mixtures thereof and the like. Other conventional additives may also be included, for example, anti-icing agents, demulsifiers, corrosion inhibitors, dyes, deposit modifiers, multipurpose additives and the like.

The gasoline composition preferably includes less than about 1 cc, in particular about 0.5 cc, of lead containing anti-knock compound or octane enhancer per gallon. The present compositions are useful in combination with lead-free gasoline compositions. The octane number of the gasoline composition is preferably less than about 93. The octane numbers referred to herein are determined by taking one half (½) of the sum of the octane number determined by the conventional research method plus the octane number determined by the conventional motor method. Good results are obtained when the gasoline composition has an octane number of less than about 90. The gasoline composition, in one embodiment, has an octane number in the range of about 85 to about 90.

When the present composition is included in, e.g., added to, an individual fuel supply reservoir, i.e., fuel tank, of an individual internal combustion engine, it is preferred that such composition be present in an amount in the range of about 0.3% to about 10%, more preferably about 0.7% to about 4%, by volume of the total gasoline composition and present additive composition in the reservoir.

The present additive composition is preferably added to the fuel reservoir at the same time the gasoline composition is added to the reservoir. The additive composition is preferably added to the reservoir separate and apart from the gasoline composition. For example, a known quantity of gasoline composition can be purchased and pumped into the fuel supply reservoir. After this pumping operation, an amount of the present composition can be added to the fuel supply reservoir to provide for increased engine performance.

The present compositions may be employed to increase the performance of any gasoline-fueled, spark ignited internal combustion engine. Preferably, the engine is associated with, e.g., is used to power, a transportation vehicle.

The following non-limiting examples illustrate certain aspects of the present invention.

EXAMPLES 1 TO 6

A series of six (6) compositions were prepared for testing by blending together the various raw materials. These compositions were as follows:

| | Wt. % | | | | | |
|---|---|---|---|---|---|---|
| Example | Toluene | Ethyl Benzene | Para Xylene | Meta Xylene | Ortho Xylene | Petroleum[1] Cut |
| 1 | 53.4 | 9.0 | 3.6 | 30.4 | 3.4 | — |
| 2 | 100.0 | — | — | — | — | — |
| 3 | 12.3 | 17.0 | 6.9 | 57.1 | 6.7 | — |
| 4 | 50.0 | — | — | — | — | 50.0 |
| 5 | 6.2 | 8.5 | 3.4 | 28.6 | 3.3 | 50.0 |
| 6 | 31.2 | 8.5 | 3.4 | 28.6 | 3.3 | 25.0 |

[1]An aromatic petroleum cut including $C_8$ to $C_{10}$ aromatic hydrocarbons, primarily $C_9$ aromatic hydrocarbons. By clay gel analysis, this material included 75.3% by weight aromatic hydrocarbons, 14.6% by weight paraffinic or saturated hydrocarbons, and 10.1% by weight naphthenic hydrocarbons or polar materials. This material is sold by Exxon Corporation under the trademark Aromatic 100.

Each of these compositions, together with two commercially available competitive products, was tested for engine performance. The performance rating was determined by judging accelerator response with and without the additive composition. The engine used for all the performance tests was the same 500 cc., 2 cylinder/4 cycle motorcycle engine. The base fuel was a commercially available leaded regular gasoline sold by Conoco, which contained about 0.5 cc. of lead-containing octane enhancer and had a octane number of 87.

Results of these performance tests were as follows:

| Example | Performance Rating |
|---|---|
| 1 | Best |
| 2 | Poor |
| 3 | Fair |
| 4 | Poor |
| 5 | Poor |
| 6 | Fair |
| Competitive Product A[2] | Fair |
| Competitive Product B[3] | Fair |

[2]Product sold by Buy-Wright Oil Company under the trademark California Gold.
[3]Product sold by STP Corporation under the trademark Octane Performance Booster.

These results demonstrate the surprising effectiveness of the composition of Example 1, an embodiment of the present invention. Thus, the Example 1 composition provided the best engine performance, while all the other compositions received only fair or poor performance ratings. Particularly surprising is the advantage of the composition of Example 1 over the composition of Example 2, which contained 100% toluene, and Example 4, which contained 50% toluene and 50% of a $C_8$–$C_{10}$ aromatic petroleum cut. Moreover, even a composition, Example 3, which contained only toluene and $C_8$ alkyl aromatic hydrocarbons, but in concentrations other than the concentrations of the present invention, provided a lower performance rating than did Example 1. Also, the composition of Example 1 provided better engine performance than did the commercially available products tested.

EXAMPLES 7 and 8

The composition of Example 1 was tested to determine the effect of this composition on mileage per unit volume of fuel.

Four vehicles were selected for testing. Each of the vehicles was a standard production model in good operating condition and had been previously used in on-road routine service. These vehicles were as follows:

Motorcycle—equipped with a 500 cc., 2 cylinder/4 cycle engine

Van—equipped with a 2.3 liter, 4 cylinder engine

Truck—equipped with a 351 cu. in., Windsor 8 cylinder engine

Automobile—equipped with a 2.7 liter, 4 cylinder engine

Varying amounts (as indicated below) of the composition of Example 1 were added to the fuel tank of each of the vehicles after the fuel tank had been otherwise filled with a base fuel, as described in Example 1 to 6. The vehicle was then used in on-road routine service. The duration of each test was that required to use at least ¾ of a full tank of fuel. The effect on mileage per unit volume of fuel was determined by subtracting the mileage per unit volume of fuel without the composition of Example 1 from the mileage per unit volume of fuel with the composition of Example 1 and dividing this difference by the mileage per unit volume of fuel without the composition of Example 1. This result was multiplied by 100 to express the effect on mileage per unit volume of fuel as a percent.

Results of these tests were was follows:

| AMOUNT OF COMPOSITION OF EXAMPLE 1 ADDED, oz/gal of base gasoline fuel | IMPROVEMENT IN MILEAGE PER UNIT VOLUME OF FUEL, % | | | |
|---|---|---|---|---|
| | Motorcycle | Van | Truck | Automobile |
| 1 | 0 | 20 | — | — |
| 2 | 17.4 | 48 | 24.8 | 36.1 |
| 3 | 7.2 | — | — | — |

For comparison purposes, Competitive Product A was tested in the motorcycle at 2 oz./gal. of base gasoline and was found to provide 13.0% improvement in mileage per unit volume of fuel.

These results demonstrate the very substantial increase in mileage per unit volume of fuel obtained using the present composition. This is particularly surprising since the present composition accounted for no more than 2.3 volume % of the fuel in the fuel tank. Also, the present composition provided an increased improvement in mileage per unit volume of fuel relative to the improvement achieved by using Competitive Product A.

While this invention has been described with respect to various specific examples and embodiments, it is to be understood that the invention is not limited thereto and that it can be variously practiced within the scope of the following claims.

What is claimed is:

1. A composition of matter comprising about 45% to about 55% by weight of toluene and about 45% to about 55% by weight of $C_8$ alkyl aromatic component selected from the group consisting of ethylbenzene, paraxylene, metaxylene, orthoxylene and mixtures thereof.

2. The composition of claim 1 wherein said composition consists essentially of toluene and said $C_8$ alkyl aromatic component.

3. The composition of claim 1 wherein said $C_8$ alkyl aromatic component includes ethylbenzene, paraxylene, metaxylene and orthoxylene.

4. The composition of claim 1 wherein toluene is present in an amount in the range of about 50% to about 55% by weight and said $C_8$ alkyl aromatic component is present in an amount in the range of about 45% to about 50% by weight.

5. The composition of claim 4 wherein said composition consists essentially of toluene and said $C_8$ alkyl aromatic component.

6. A method of increasing the performance rating of a gasoline-fueled, spark ignited internal combustion engine associated with a transportation vehicle having a reservoir for gasoline fuel on board, said method comprising:

adding to said reservoir a composition comprising about 45% to about 55% by weight of toluene and about 45% to about 55% by weight of $C_8$ alkyl aromatic component selected from the group consisting of ethylbenzene, paraxylene, metaxylene, orthoxylene and mixtures thereof; and adding to said reservoir, separate and apart from said composition, a quantity of gasoline fuel, said composition being present in said reservoir in an amount of about 0.3% to about 10% by volume of the total of the gasoline fuel and said composition present in said reservoir.

7. The method of claim 6 wherein said composition consists essentially of toluene and said $C_8$ alkyl aromatic component.

8. The method of claim 6 wherein said $C_8$ alkyl aromatic component includes ethylbenzene, paraxylene, metaxylene and orthoxylene.

9. The method of claim 6 wherein said composition includes about 50% to about 55% by weight of toluene and about 45% to about 50% by weight of said $C_8$ alkyl aromatic component.

10. The method of claim 9 wherein said composition consists essentially of toluene and said $C_8$ alkyl aromatic component.

11. The method of claim 6 wherein said composition is present in said reservoir in an amount effective to increase the mileage per unit volume of fuel of said vehicle.

12. The method of claim 6 wherein said composition is present in said reservoir in an amount of about 0.7% to about 4% by volume of the total of the gasoline fuel and said composition present in said reservoir.

13. The method of claim 6 wherein said gasoline fuel has an octane number of less than about 93.

14. The method of claim 6 wherein said gasoline fuel has an octane number of less than about 90.

15. The method of claim 6 wherein said gasoline fuel has an octane number in the range of about 85 to about 90.

16. The method of claim 6 wherein said gasoline fuel further includes less than about 1 cc of lead-containing octane enhancer per gallon.

17. A composition comprising a major amount of gasoline fuel and about 0.3% to about 10% by volume of an additional material comprising about 45% to about 55% by weight of toluene and about 45% to about 55% by weight of $C_8$ alkyl aromatic component selected from the group consisting of ethylbenzene, parazylene, metaxylene, orthoxylene and mixtures thereof, said additional material being included in said composition separately from said gasoline fuel.

18. The composition of claim 17 wherein said additional material consists essentially of toluene and said $C_8$ alkyl aromatic component.

19. The composition of claim 17 wherein said additional material includes about 50% to about 55% by weight of toluene and about 45% to about 50% by weight of said $C_8$ alkyl aromatic component.

20. The composition of claim 19 wherein said additional material consists essentially of toluene and said $C_8$ alkyl aromatic component.

21. The composition of claim 17 wherein said additional material is present in an amount of about 0.7% to about 4% by volume of said composition.

22. The composition of claim 17 wherein said gasoline fuel has an octane number of less than about 93.

23. The composition of claim 17 wherein said gasoline fuel has an octane number of less than about 90.

24. The composition of claim 17 wherein said gasoline fuel has an octane number in the range of about 85 to about 90.

25. The composition of claim 17 wherein said gasoline fuel further includes less than about 1 cc of lead-containing octane enhancer per gallon.

* * * * *